US006473974B1

(12) United States Patent
Ireland

(10) Patent No.: US 6,473,974 B1
(45) Date of Patent: Nov. 5, 2002

(54) KNIVES

(76) Inventor: William Alfred Ireland, 257 Pirton Lane, Churchdown, Gloucestershire GL3 2QJ (GB)

( * ) Notice: Subject to any disclaimer, the term of this patent is extended or adjusted under 35 U.S.C. 154(b) by 0 days.

(21) Appl. No.: 09/568,118

(22) Filed: May 10, 2000

(30) Foreign Application Priority Data

May 11, 1999 (GB) ..... 9910730

(51) Int. Cl.[7] ..... B26B 3/00
(52) U.S. Cl. ..... 30/279.6; 30/294
(58) Field of Search ..... 30/279.6, 294, 30/123.5, 123.7, 50, 283, 284

(56) References Cited

U.S. PATENT DOCUMENTS 242,985 A * 6/1881 Rischow ..... 30/162
2,697,874 A * 12/1954 Tomchek ..... 30/50
3,465,437 A * 9/1969 Brown ..... 30/279.6
3,488,764 A * 1/1970 Welsh ..... 30/50
3,593,416 A * 7/1971 Edison ..... 30/50
3,768,162 A * 10/1973 Perry ..... 30/50 X
5,575,070 A * 11/1996 Anderson ..... 30/283

* cited by examiner

*Primary Examiner*—Douglas D. Watts
(74) *Attorney, Agent, or Firm*—Andrus, Sceales, Starke & Sawall

(57) ABSTRACT

A safety knife for removing flashing from plastics mouldings, or other similar operations, comprises a handle and two blades mounted to project side-by-side from the handle. The cutting edge of each blade is substantially parallel to, and slightly spaced from, the cutting edge of the ether blade, and the general planes of the blades diverge as they extend away from their cutting edges. When the knife is not in use each bade serves us a guard for the other blade so as to reduce the risk of accidental injury.

26 Claims, 4 Drawing Sheets

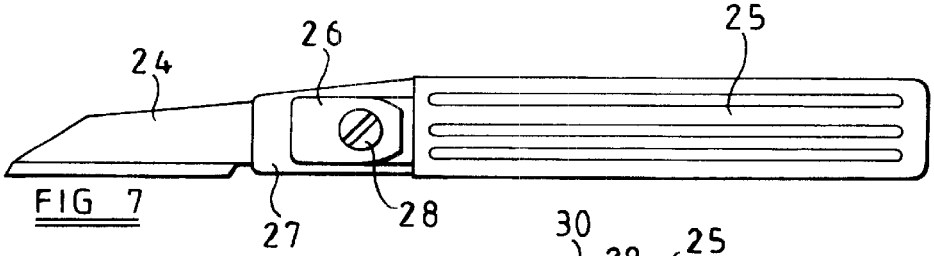
FIG 7
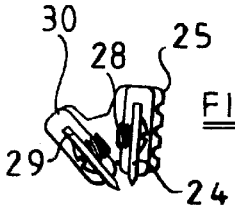
FIG 8
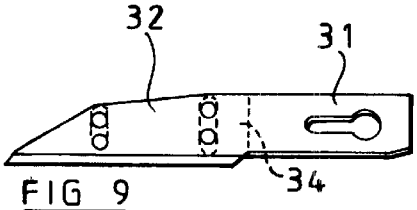
FIG 9
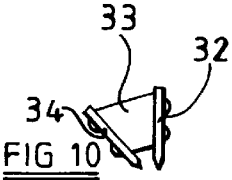
FIG 10
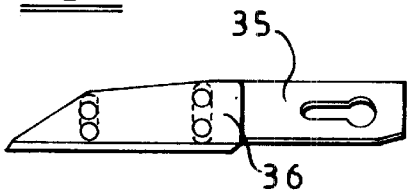
FIG 11
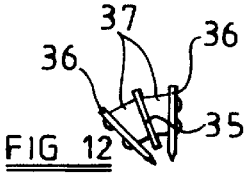
FIG 12
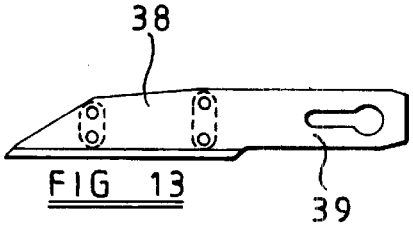
FIG 13
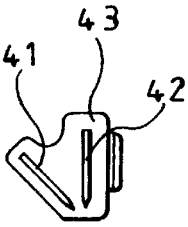
FIG 16
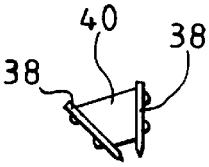
FIG 14
FIG 15
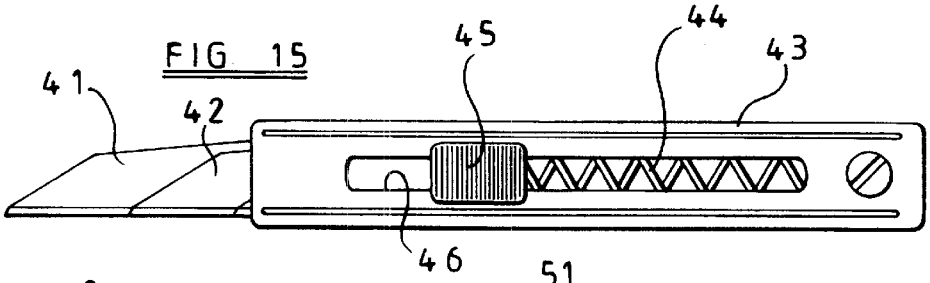
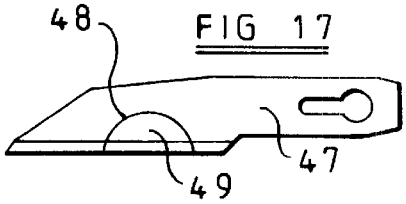
FIG 17
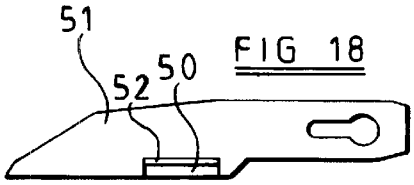
FIG 18
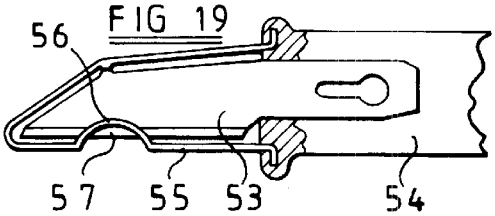
FIG 19
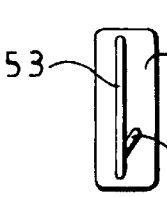
FIG 20

FIG 21
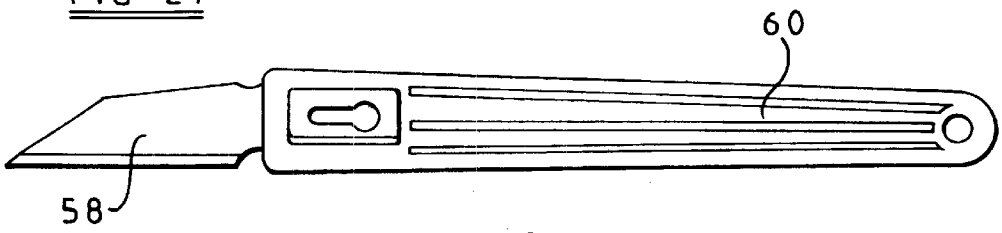
FIG 22
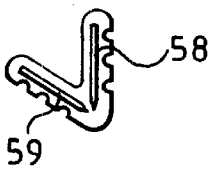
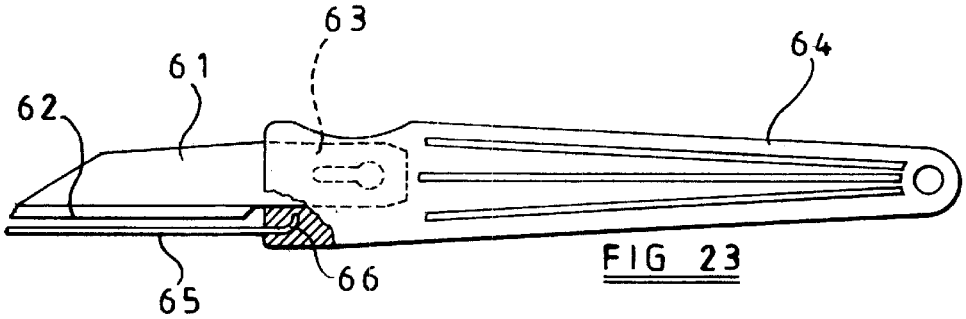
FIG 23
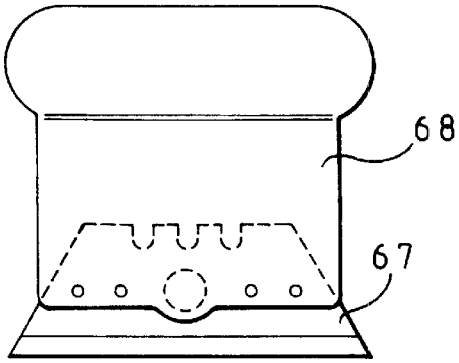
FIG 24
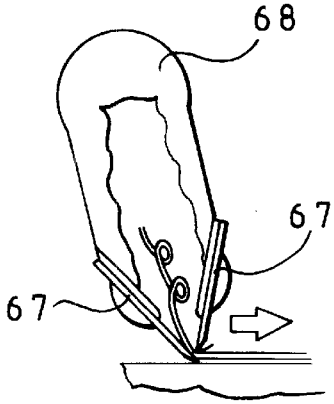
FIG 25

FIG 26
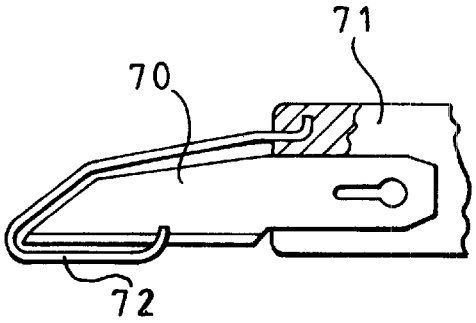
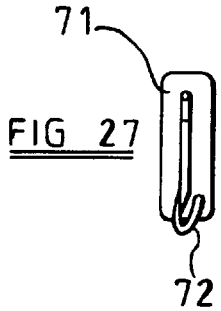
FIG 27
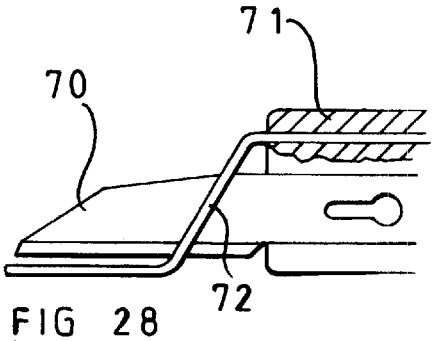
FIG 28
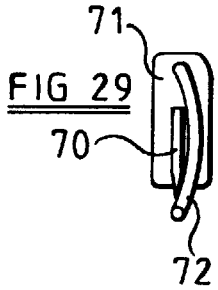
FIG 29
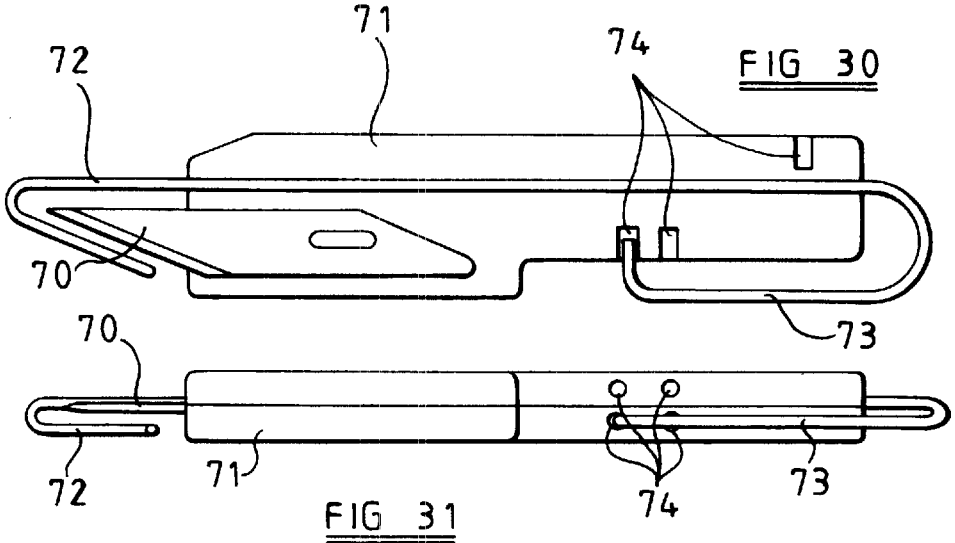
FIG 30
FIG 31

KNIVES

The invention relates to knives and provides a knife which is particularly suitable for removing flashing from small plastics mouldings, as well as for other similar tasks. Flashing may be removed from plastics mouldings by inclining the blade of a knife to the surface of the moulding and running the cutting edge of the blade along the surface at an angle, either towards or away from the user, so as to strip the flashing from the moulding.

While this may be achieved with a knife having a simple exposed blade, it is desirable, particularly for industrial use, that the cutting edge of the blade should be guarded so as to prevent accidental injury to the user. A common type of safety knife for this purpose comprises a train body formed with a slot, the blade being mounted on the main body with a portion of the cutting edge of the blade extending across the slot at a location spaced inwardly from the mouth of the slot. With such a knife materials may be cut by introducing the material into the slot and pushing or pulling the knife across it so that the material is forced against the blade. Since the blade is protected within the slot the risk of injury to the user is slight.

However, there are many types of plastics mouldings, and particularly very small mouldings, where the use of such a safety knife may be inappropriate and may not allow sufficient access to the flashing in the required manner. For example, many plastics mouldings are formed with small holes where flashing projects from the inner periphery of the hole. It is not possible to remove such flushing with a safety knife of the kind described.

The present invention provides an improved form of knife where the cutting edge of the blade is protected but where the cutting edge may reach regions of a moulding which might be inaccessible to the blade of a conventional safety knife, According to the invention there is provided a knife comprising a handle, a blade, having a cutting edge, mounted on the handle, and a guard mounted on the handle alongside the blade, the guard having an edge which is substantially parallel to, and spaced from, the cutting edge of the blade. Preferably the edge of the guard is located beyond the cutting edge and to one side of the general plane of the blade.

The guard tray comprise an elongate rod-like element extending generally parallel to at least a portion of the cuffing edge of the blade. Preferably, however, the guard comprises a plate-like element, the general plane of which is inclined at an angle to the general plane of the blade, so that the guard and blade diverge as they extend away from the cutting edge of the blade.

In a preferred embodiment the plate-like guard comprises a second blade having a cutting edge, the cutting edge of the second blade being substantially parallel to, and spaced from, the cutting edge of the first said blade.

Each blade may comprise a main part having a cutting edge, and a root part which is mounted on the handle of the knife.

Alternatively the first blade may comprise a main part having a cutting edge, and a root part which is mounted on the handle of the knife, and the second blade is mounted on the first blade. The second blade may be mounted on the first blade by means of a spacer shaped to hold the blades qt the required angle to one another.

In another arrangement the first and second blades may be both mounted on a support element which is, in turn, mounted on the handle of the knife. The support element may comprise a metal tang on opposite sides of which the blades are mounted at the required angle to one another by spacers, the metal tang having a root part which in mounted on the handle of the knife.

In any of the above arrangements where two blades are provided, the two blades may be connected together by a spacer so as form a unit.

In any of the above arrangements also the cutting edge of one of the blades may be formed with a cut-out, which may, for example, be semi-circular.

Where the guard is a plate-like element the edge of the plate-like element may be formed with a cut-out.

In any of the arrangements according to the invention at (cast one blade may be detachably mounted on the handle. For example, at least one blade may be mounted on an intermediate heart part which is detachably mounted on the handle. The head part may be formed from a material which is integrally moulded around a part of the blade or blades.

Alternatively, at least one blade may be permanently mounted on the handle. For example, the handle may be formed from a material which is integrally moulded around a part of the blade or blades.

At least one blade may be mounted on the handle so as to be retractable into the handle. The retractable blade is preferably spring-urged to an extended position where its cutting edge projects from the handle, there being connected to the blade a manipulating member by movement of which the blade can be retracted into the handle against the action of the spring. Where two blades are provided, both blades may be retractable into the handle.

The invention includes within its scope an assembly of two blades connected together by a spacer so that the cutting edge of each blade is substantially parallel to, and spaced from, the cutting edge of the other blade.

The following is a more detailed description of embodiments of the invention, by way of example, reference being made to the accompanying drawings in which.

Figure 1:
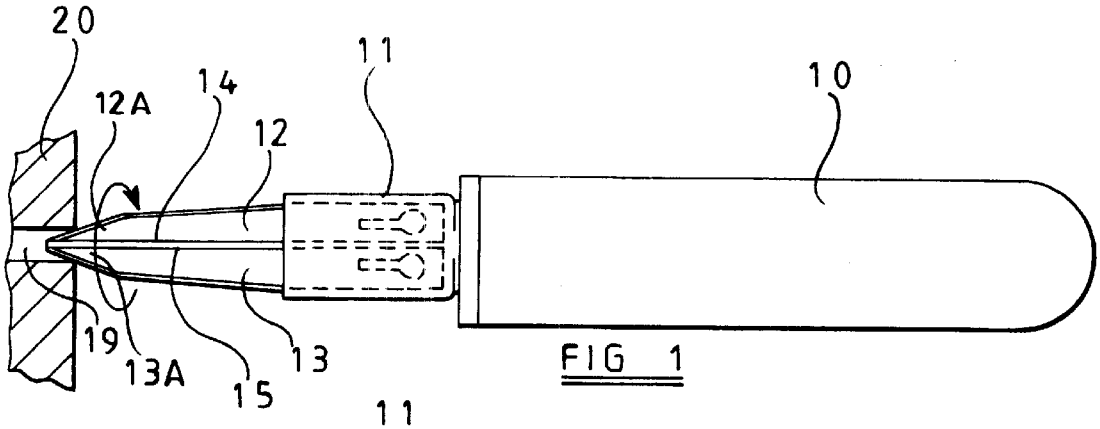
FIG. 1 is a top view of one form of knife in accordance with the invention.
Figure 2:
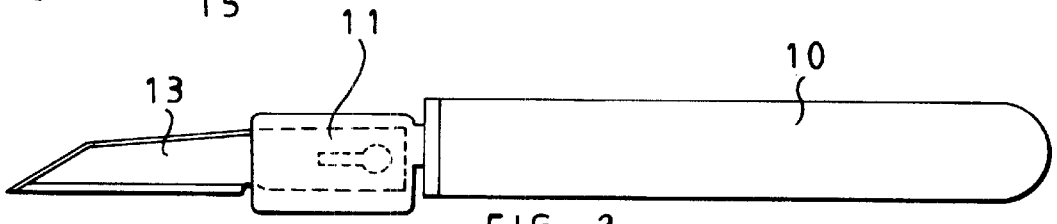
FIG. 2 is a side elevation of the knife shown in FIG. 1.
Figure 3:
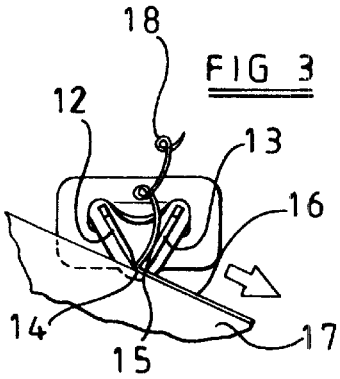
Figure 4:
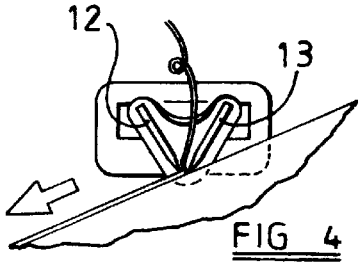
Figure 5:
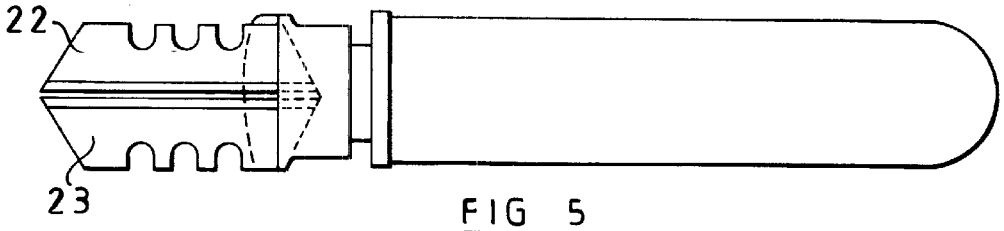
Figure 6:
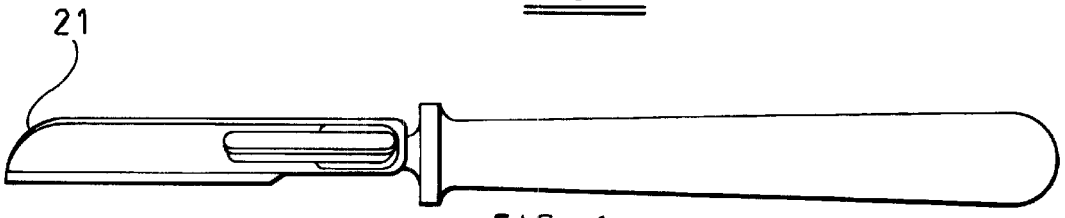

FIGS. 3 and 4 are end elevations of the knife of FIGS. 1 and 2 showing different modes of cutting action, FIG. 5 is a lop view of an alternative form of knife according to the invention, FIG. 6 is a side view of another form of knife in accordance with the invention, FIG. 7 is a side view of a further form of knife, FIG. 8 is an end view of the knife shown in FIG. 7, FIGS. 9–14 show alternative forms of blade assembly for use in knives according to the invention, FIG. 15 is a side elevation of a knife, according to the invention, having a retractable blade, FIG. 16 in an end view of the knife shown in FIG. 15, FIGS. 17 and 18 are side views of further forms of blade assembly, FIG. 19 is a side view of part of a knife where the blade is guarded by a wire loop, FIG. 20 is an end view of the knife of FIG. 19, FIG. 21 is a side elevation of a further form of knife according to the invention, FIG. 22 is an end view of the knife shown in FIG. 21, FIG. 23 is a side view of a further form of knife according to the invention, FIG. 24 in a side view of a further form of knife according to the invention, FIG. 25 is a diagrammatic view showing the knife of FIG. 24 in use, and FIGS. 26 to 31 are views of three further alternative embodiments.

Referring first to FIGS. 1 and 2, the knife comprises a handle 10, which may be conveniently moulded from plastics, to which is detachably connected a head portion 11 from which project two similar flat blades 12 and 13.

The head portion 11 may also be moulded from plastic, material and the blades 12, 13 may be integrally bonded into the head portion 11 or may be detachable therefrom. The head portion 11 is preferably detachable from the handle 10 so that the handle may be re-used with new head portions. Any conventional arrangement may be employed for securing the blades to the head portion 11 of directly to the handle 10, including conventional clamping or "keyhole" arrangements. However, arrangements are possible where the blades 12 and 13 are permanently or detachably mounted on the handle itself, as will be described.

The blades 12, 13 have cutting edges 14, 15 respectively and, as may best be seen in FIGS. 3 and 4, the cutting edges 14, 15 are parallel to one another, and spaced a short distance apart, and the blades 12, 13 themselves diverge at an angle of about 60° as they extend away from the cutting edges. The blades are formed with points 12A and 13A.

FIGS. 3 and 4 show the knife in use stripping flashing 16 from a plastics moulding 17. The knife is held so that one of the blades (l2 in FIG. 3) in inclined at about 30° to the surface of the moulding 17 and the other blade (13 in FIG. 3) then extends at roughly a right angle to the surface of the moulding. By pushing or pulling the knife along the surface of the moulding, as indicated by the arrow, the blade 12 strips the flashing from the surface of the moulding as indicated at 18. Due to the spacing between the cutting edges 14 and 15 of the two blades, when the cutting edge 14 engages the surface of the moulding 17 the cutting edge 15 of the blade 13 is spaced a short distance about the surface of the moulding thus allowing the flashing to pass beneath the blade 13 to engage the cutting edge 14 of the blade 12.

Since the blades are flexible, if the blade 13 comes up against an edge or stop during the de-flashing movement, the blade will flex allowing the cutting edge of the blade 12 to pass right up to the edge or stop.

As shown in FIG. 4, the other blade 13 tray alternatively be used to strip the flashing from the moulding, by moving the knife in the opposite direction. Thus, the knife may be used with a pushing or a pulling action by either a right handed or left handed person.

Referring to FIG. 1, the points 12A and 13A of the blades may be introduced info a small hole 19 in a plastics moulding 20 and rotated truck and forth so as to strip any flashing from the interior of the mouth of the hole. Since the back edges of the points 12A and 13A are square cut, this effectively provides four rotating edges for stripping the flashing from the moulding. As is commonly practised the backs of the blades 12 and 13 may also be used for stripping some types of flashing.

It will be soon that, although the cutting edges of both blades are exposed, each blade acts as a guard to protect and shield the cutting edge of the other blade, thus providing a substantial measure of safety for the user when compared with a single blade having an exposed cutting edge. Thus, when one blade is pressed at right angles towards a part of the user's body, the other blade extends at a more shallow angle to the body and thus prevents the first blade cutting deeply into the body.

Although pointed ends to the blades may themselves be useful, as shown in FIG. 1, safety may be increased by rounding the back edge of each blade as indicated at 21 in the alternative arrangement shown in FIG. 6.

FIG. 5 shows a further alternative type of knife according to the invention, where the narrow blades 12, 13 of FIGS. 1 and 2 are replaced by broader blades 22, 23 of a kind commonly used in some types of retractable blade woodworking knife. In this arrangement also the cutting edges of the two blades are parallel to one another and spaced slightly apart, the general planes of the blades being inclined at an angle to one another so that the blades diverge as they extend away from the cutting edges.

FIGS. 7 and 8 show a further form of two-bladed knife in accordance with the present invention. In this case one blade 24 is generally aligned with the handle 25 and a root portion 26 of the blade is received in a narrow slot in an end part 27 of the handle 25. The root 26 of the blade in retained in the slot by a retaining screw 28 or any other suitable releasable detent device.

As best seen in FIG. 8 the second blade 29 is similarly removably retained in a lateral extension 30 of the handle 25 so that the blade 29 is held at an angle of about 60° to the blade 24 so that, the blades may be used for removing flashing as described above in relation to FIGS. 3 and 4.

Other mounting arrangements for the blades are possible and various arrangements are shown in FIGS. 9–14. In the arrangement of FIG. 9 the root portion 31 of the main blade 32 is received and retained in conventional manner in a handle (not shown) which may be a standard handle of the type commonly used with blades of the kind. In the present case, however, there in bonded or otherwise secured to one side face of the sharpened portion of the blade 32 a trapezium-sectioned block 33 to which is bonded or otherwise secured a second blade 34. The blade 34 is similar in shape to the blade 32 except that it is not formed with a root port corresponding to the root part 31 of the blade 32. Thus, the blade assembly shown in FIGS. 9 and 10 may be mounted in any appropriate standard knife handle and used to trim flashing us previously described.

FIGS. 11 and 12 show an alternative arrangement where there is provided a central steel tang 35 which is shaped to be received in a standard knife handle. Two similar blade portions 36 are bonded or otherwise secured symmetrically to opposite sides of the tang 35 by means of spacer blocks 37 so that the two blade portions 36 are held at the required angle to one another. As may be seen from FIG. 11 each blade portion 36 comprises only the cutting part of a blade and a not provided with a root portion. The double-blade assembly is mounted on a handle solely by means of the central tang 35.

In the arrangement of FIGS. 13 and 14 two similar standard-shaped blades 38, each having a root portion 39, are bonded or otherwise secured to opposite faces of a central block 40 so as to be held at the appropriate angle to one another. In this case a special handle is required to carry the blade assembly, the handle being formed with two slots angled to one another and adapted to receive the root portions 39 of the two blades 38.

The blocks 33, 37, 40 in the above arrangements may be made of any suitable material. In a preferred arrangement the blocks are moulded from plastics. In this case the blocks may be moulded with small bosses which pass through holes in the blades, and are then deformed by heat around the holes so as to hold the blade flat against the side face of the block.

In any of the arrangements described the blade assemblies are preferably adapted to be removable from the handle so that they can be replaced, but arrangements are also possible where the blade assemblies are integrally bonded within a handle so that the whole knife is disposable.

FIGS. 15 and 16 show a further arrangement where two separate blades 41 and 42 are separately mounted on special handle 43. Again, as may be seen in FIG. 16, the two blades are arranged at an angle to one another. In this case, however, one of the blades 42 is retractable into the handle 43. The blade 42 is urged outwardly by a helical compression spring 44 mounted within the bundle 43 and the blade 42 tray be retracted into the handle 43 by moving an external button 45, which is connected to the blade, along a slut 46 in the handle. This allows the blade 42 to be retracted into handle, if desired so that the blade 41 may be used as a conventional unguarded blade. If desired, both blades may be independently retractable into the handle so that, either blade may be used on its own.

In the blade arrangement shown in FIG. 17, one of the blades 47 is provided with a semi-circular cut-out 48 through which the other blade 49 is accessible. In this case the cut-out 48 allows the blade 49 to cope with large pieces of flashing.

In all of the arrangements so far described, both blades have a cutting edge and cach blade acts as a guard with respect to the other. However, as previously mentioned, arrangements are possible where there is provided only one blade with a cutting edge, the guard being in the form of an unsharpened element which does not act as a blade. Such an arrangement is shown in FIG. 18 where a blade having a cutting edge 50 is guarded by an unsharpened steel guard 51 which has the same general shape as the sharpened blade and is arranged at an angle to it, for example as shown in any of the arrangements of FIGS. 8, 10, 12 and 14, so as to provide a guard for the cutting edge 50 of the blade. In the arrangement shown in FIG. 18 the guard 51 is formed with a rectangular cut-out 52 to permit larger pieces of flashing to be removed. However, this is not essential and the cut-out 52 could be omitted.

The arrangements of FIGS. 17 and 18 are suitable for use by a right-handed person drawing the blade assembly across the flashing with a pulling action. For use with a pushing action, or for a left-handed person, the cut-out 48 in the FIG. 11 arrangement may be formed in the blade 49 and not in the blade 47. Similarly, in the arrangement of FIG. 18 the guard 51 may be on the other side of the blade 50.

FIGS. 19 and 20 show an alternative arrangement where the guard does not comprise a blade with a cutting edge. In this case the blade 53 mounted on a handle 54 is guarded by a suitably profiled wire loop 55 which is mounted in the handle 54 and extends around the periphery of the exposed sharpened portion of the blade 33. A portion 56 of the wire loop 55 adjacent the cutting edge of the blade is curved upwardly to lie along one side of the blade 53 and expose a portion 57 of the cutting edge. This portion 57 of the cutting edge is therefore available for removing flashing, but in also protected by the stretches of the wire loop 55 on each side thereof.

The further form of knife shown in FIGS. 21 and 22 has blades 58, 59 which are generally similar to the blades of the knife shown in FIGS. 7 and 8, but in this case the blades are integrally moulded into a simple one-piece plastics handle 60. The knife is thus simple and cheap to manufacture and may be thrown away when the blades become blunted or damaged. However, the simple knife handle of FIGS. 21 and 22 could also be modified so that the blades are detachable. For further safety the two blades could have rounded noses instead of the pointed tips shown in the drawings.

In the further form of knife shown in FIG. 23 there is provided only a single blade 61 with a cutting edge 62, the root portion 63 of the blade being integrally moulded within a one-piece plastics handle 64. In this case the cutting edge 62 of the blade is guarded by a rigid rod 65 which also has a root portion 66 integrally moulded into the handle 64. The rod 65 in spaced below and to one side of the cutting edge 62 so as to provide a guard for the cutting edge while at the same time allowing the edge to contact and strip flashing from a plastics moulding. The rod 65, could, if desired, be replaced with a plate or other form of guard.

FIGS. 24 and 25 show a further form of knife using a pair of conventionally-shaped craft knife blades 67 secured to a short stubby handle 68 by suitable pins (not shown). In this case the interior of the handle may be hollow to provide a receptacle for swarf when the knife is in use, as best seen in FIG. 25.

The adjacent pointed lips of the two blades may be used for cleaning and reaming a hole in a work piece, by rotating the blades, in similar manner to the arrangement shown in FIG. 1.

In any of the arrangements described where the blades are fixed, one or both blades could be mounted on the handle so as to be retractable for safety.

In the arrangements of FIGS. 19 and 23, a fixed guard is associated with a blade of a single bladed knife. It is thought that most accidents occur where the end of the blade in exposed. It is desirable for part of the blade to be exposed whilst providing a guard associated with the end of the blade. An arrangement of this type is shown in FIG. 26.

The knife shown in FIG. 26 includes a blade 70 mounted upon a handle 71. A wire guard 72 is secured to the handle 71, the guard extending along the upper edge of the blade 70, around the tip thereof and alongside part of the cutting edge of the blade 70. As shown in FIG. 27, the part of the guard 72 located adjacent the cutting edge of the blade 70 lies outside of the plans of the blade 70 thus allowing use of the part of the cutting edge close to the tip whilst providing a degree of protection. The part of the cutting edge close to the handle 71 is not protected at all by the guard 72. The handedness of the knife can be adjusted simply by deflecting the guard 72 to lie alongside the opposite side of the blade 70.

FIGS. 28 and 29 illustrate another embodiment similar to that of FIGS. 26 and 27, but in which the guard 72 does not extend around the tip of the blade 70 but rather extends across the side of the blade 70. If desired a rubber-like material tube may be mounted upon part of the guard 72 that lies alongside the cutting edge.

FIGS. 30 and 31 illustrate another knife which, in many respects, is similar to that of FIGS. 26 and 27. In the knife of FIGS. 30 and 31, the guard 72 extends through a passage provided in the handle, projecting from the end of the handle 71 remote from the blade 70. The guard 72 is shaped to include a portion 73 that lies alongside part of the handle 71 and is co-operable with a series of recesses 74 provided in the handle 71. The guard 72 is movable axially end angularly relative to the handle 71, the co-operation of the portion 73 with the recesses 74 permitting the guard 72 to be locked in a desired position. The recesses 74 are positioned to permit the guard to be locked in positions in which it lies spaced from either side of the cutting edge, thereby permitting adjustment of the handedness of the knife. The guard can also be moved to positions in which the blade is protected over the fully cutting edge thereof, or to a position in which the blade in fully exposed. It will be appreciated that, this knife is very versatile.

Various modifications may be made to the described arrangements without departing from the scope of the invention. For example, in FIGS. 1 and 2, the head portion of the knife, carrying the blades, may be arranged to be rotatable with respect to the handle.

Although an angle of about 60° between the blades is preferred, greater or smaller angles may be employed, including obtuse angles of greater than 90°. It will be appreciated that the safety of the knife increases with increase in the angle.

Instead of two blades being provided, there may be provided three blades arranged in a generally triangular configuration, or four blades arranged in a generally rectangular or diamond-shaped configuration. In such cases each blade may have a single cutting edge; or the blades may have parallel cutting edges on opposite edges thereof.

Although the knives are shown as having blades with straight cutting edges, arrangements are possible where the blades have curved cutting edges.

I claim:

1. A knife comprising a handle, a blade having a cutting edge, the blade being mounted on the handle, and a guard in the form of a blade mounted on the handle alongside the blade so as to be retractable into the handle, the guard being spring biased towards an extended position in which an edge thereof lies substantially parallel to, and spaced from, the cutting edge of the blade, there being connected to the guard a manipulating member by movement of which the blade can be retracted into the handle against the action of the spring.

2. A de-flashing knife comprising a handle, a first blade, having a cutting edge, mounted on the handle, and a guard mounted on the handle alongside the first blade, the guard extending substantially parallel to, and spaced from the cutting edge of the first blade, the guard being mounted on the handle so as to be moveable relative to the first blade, wherein the guard comprises a second blade, the general plane of which is inclined at an angle to the general plane of the first blade, so that the guard and second blade diverge as they extend away from the cutting edge of the first blade, the second blade having a cutting edge, the cutting edge of the second blade being substantially parallel to, and spaced from, the cutting edge of the first blade, and wherein the first blade comprises a main part having a cutting edge, and a root part which is mounted on the handle of the knife, and the second blade is mounted on the first blade.

3. A knife according to claim 2, wherein the second blade is mounted on the first blade by means of a spacer shaped to hold the first and second blades at the required angle to one another.

4. A de-flashing knife comprising a handle, a blade, having a cutting edge, mounted on the handle, and a guard mounted on the handle alongside the blade, the guard extending substantially parallel to, and spaced from, the cutting edge of the blade, the guard being mounted on the handle so as to be moveable relative to the blade, wherein the guard comprises a second blade, the general plane of which is inclined at an angle to the general plane of the first blade, so that the guard and second blade diverge as they extend away from the cutting edge of the first blade, the second blade having a cutting edge, the cutting edge of the second blade being substantially parallel to, and spaced from, the cutting edge of the first blade, the first and second blades both being mounted on a support element which is, in turn, mounted on the handle of the knife, the support element comprising a metal tang on opposite sides of which the first and second blades are mounted at the required angle to one another by spacers, the metal tang having a root part which is mounted on the handle of the knife.

5. A de-flashing knife comprising a handle, a blade, having a cutting edge, mounted on the handle, and a guard mounted on the handle alongside the blade, the guard extending substantially parallel to, and spaced from, the cutting edge of the blade, the guard being mounted on the handle so as to be moveable relative to the blade, wherein the guard comprises a second blade, the general plane of which is inclined at an angle to the general plane of the first blade, so that the guard and second blade diverge as they extend away from the cutting edge of the first blade, the second blade having a cutting edge, the cutting edge of the second blade being substantially parallel to, and spaced from, the cutting edge of the first blade, and wherein the cutting edge of one of the first and second blades is formed with a semi-circular cut-out.

6. A knife according to claim 5, wherein each blade comprises a main part having a cutting edge, and a root part which is mounted on the handle of the knife.

7. A knife according to claim 5, wherein the first blade comprises a main part having a cutting edge, and a root part which is mounted on the handle of the knife, and the second blade is mounted on the first blade.

8. A knife according to claim 7, wherein the second blade is mounted on the first blade by means of a spacer shaped to hold the blades at the required angle to one another.

9. A knife according to claim 5, wherein the first and second blades are both mounted on a support element which is, in turn, mounted on the handle of the knife.

10. A knife according to claim 9, wherein the support element comprises a metal tang on opposite sides of which the blades are mounted at the required angle to one another by spacers, the metal tang having a root part which is mounted on the handle of the knife.

11. A knife according to claim 6, wherein the two blades are connected together by a spacer so as to form a unit.

12. A knife according to claim 5, wherein at least one blade is detachably mounted on the handle.

13. A knife according to claim 12, wherein at least one blade is mounted on an intermediate head party which is detachably mounted on the handle.

14. A knife according to claim 13, wherein the head part is formed from a material which is integrally moulded around a part of the blade or blades.

15. A knife according to claim 5, wherein at least one blade is permanently mounted on the handle.

16. A knife according to claim 15, wherein the handle is formed from a material which is integrally moulded around a part of one of the blade or both blades.

17. A de-flashing knife comprising a handle, a blade, having a cutting edge, mounted on the handle, and a guard mounted on the handle alongside the blade, the guard extending substantially parallel to, and spaced from, the cutting edge of the blade, the guard being mounted on the handle so as to be moveable relative to the blade, wherein the blade is detachably mounted on the handle, the blade being mounted on an intermediate head part which is detachably mounted on the handle, the head part being formed from a material which is integrally mounted around a part of the blade.

18. A de-flashing knife comprising a handle, a blade, having a cutting edge, mounted on the handle, and a guard mounted on the handle alongside the blade, the guard extending substantially parallel to, and spaced from, the cutting edge of the blade, the guard being mounted on the handle so as to be moveable relative to the blade, wherein the blade is mounted on the handle so as to be retractable into the handle, the blade being spring-urged to an extended position where its cutting edge projects from the handle, there being connected to the blade a manipulating member by movement of which the blade can be retracted into the handle against the action of the spring.

19. A knife according to claim 18, wherein the guard has an edge which is located beyond the cutting edge and to one side of the general plane of the blade.

20. A knife according to claim 18, wherein the guard comprises an elongate rod-like element extending generally parallel to at least a portion of the cutting edge of the blade.

21. A knife according to claim 18, wherein the guard comprises a plate-like element, the general plane of which is inclined at an angle to the general plane of the blade, so that the guard and blade diverge as they extend away from the cutting edge of the blade.

22. A knife according to claim 21, wherein the plate-like guard comprises a second blade having a cutting edge, the cutting edge of the second blade being substantially parallel to, and spaced from, the gutting edge of the first said blade.

23. A knife according to claim 22, wherein each blade comprises a main part having a cutting edge, and a root part which is mounted on the handle of the knife.

24. A knife according to claim 22, wherein the first blade comprises a main part having a cutting edge, and a root part which is mounted on the handle of the knife, and the second blade is mounted on the first blade.

25. A knife according to claim 24, wherein the second blade is mounted on the first blade by means of a spacer shaped to hold the blades at the required angle to one another.

26. A knife according to claim 18, wherein two blades are provided and both blades are retractable into the handle.

* * * * *